United States Patent [19]

Wandl

[11] 4,290,706

[45] Sep. 22, 1981

[54] AGITATOR FOR CYLINDRICAL CONTAINES FILLED WITH PAINT OR THE LIKE

[75] Inventor: Rudolf H. Wandl, Binau, Fed. Rep. of Germany

[73] Assignee: Kurt Vogelsang GmbH, Hassmersheim, Fed. Rep. of Germany

[21] Appl. No.: 116,965

[22] Filed: Jan. 30, 1980

[30] Foreign Application Priority Data

Jan. 30, 1979 [DE] Fed. Rep. of Germany ..... 2903401
Oct. 24, 1979 [DE] Fed. Rep. of Germany ..... 2942994

[51] Int. Cl.[3] ..... B44D 3/12

[52] U.S. Cl. ..... 401/4; 366/130; 401/129

[58] Field of Search ..... 366/130, 289, 332, 333; 401/4, 129

[56] References Cited

U.S. PATENT DOCUMENTS

| | | | |
|---|---|---|---|
| 2,904,808 | 9/1959 | Massman | 366/130 X |
| 2,983,946 | 5/1961 | Edelstone et al. | 366/130 X |
| 3,085,281 | 4/1963 | Massman | 366/130 X |
| 3,336,624 | 8/1967 | Schefer et al. | 366/130 X |
| 3,606,276 | 9/1971 | Jackson | 366/130 |
| 3,738,760 | 6/1973 | Madeira | 401/4 |

FOREIGN PATENT DOCUMENTS

| | | | |
|---|---|---|---|
| 2127748 | 12/1972 | Fed. Rep. of Germany | 401/4 |

*Primary Examiner*—Philip R. Coe
*Attorney, Agent, or Firm*—Craig and Antonelli

[57] ABSTRACT

Cylindrical containers for paint or the like of the type having a hollow container body, a cap, a brush attached to the cap, and an agitator for mixing the contents of the container is improved by constructing the agitator as a tubular hollow member that is mounted within the container so as to surround the brush attached to the cap and be axially displaceable relative thereto, the agitator member having ribs that are fashioned in the manner of blades of a fan wheel and are uniformly distributed about the periphery of the agitator member with its outer edges located on an imaginary cylinder, the diameter of which is slightly smaller than the inner diameter of the container body. According to preferred embodiments, the ribs of the agitator can either be twisted helically with respect to the longitudinal axis of the hollow member or can be straight blade vanes inclined at an angle to the longitudinal axis of the agitator. According to a particularly advantageous embodiment, the axial length of the outer edges located on the imaginary cylinder are longer than the length of the tube so that the leading edges of the ribs extend inwardly at an angle with respect to the longitudinal axis from the outer edges to the hollow tube, thereby only providing localized points at the junction of the outer edges and leading edges where contacts can occur with the paint container, and the agitator cannot become stuck to the container bottom after a relatively long resting period thereon.

8 Claims, 4 Drawing Figures

AGITATOR FOR CYLINDRICAL CONTAINES FILLED WITH PAINT OR THE LIKE

BACKGROUND AND SUMMARY OF THE INVENTION

The invention concerns an agitator [stirrer element] for cylindrical containers filled with paint or the like, especially for touch-up sticks to repair paint damage on automobiles, this agitator being constructed as a tubular hollow member guided in the container in the axial direction of the latter, surrounding a brush attached to a cap, and exhibiting radially outwardly projecting ribs.

Agitators are known (German Patent No. 1,161,795) which are fashioned as a coiled wire section in the manner of a spiral-shaped compression spring. Such agitators have the disadvantage that they must be normally manufactured from spring steel and permit intensive intermixing only with repeated shaking of the container, due to their configuration. The design must in each case furthermore be such that a certain tumbling motion of the spiral spring section is made possible, because otherwise no appreciable intermixing can occur in the zones between the outside periphery and the inside diameter of the container or in the inside of the spiral spring section. Therefore, it is also necessary to observe the maintenance of tolerances regarding the outside diameter and the length of the wire section, if a jamming of the agitator is to be safely avoided.

Furthermore, known are agitators of the type mentioned hereinabove (DOS-German Unexamined Laid-Open Application 2,127,748), wherein perforated disks or cruciform parts are offset with respect to each other in the axial direction and surround a tubular inner part. However, such an arrangement has the disadvantage that the resistance of the shaker element against axial movement is likewise increased by the surface area of the disks, and that relatively large contact areas are produced between the lowermost disk and the container bottom, where the element can stick to the pigments of the paint. Detachment in such a case is possible only with great difficulties, or not at all.

Therefore, the invention has an object of constructing an agitator of the type mentioned above in such a way that intensive intermixing occurs in all zones of the container, even if the container is only slightly shaken to move the agitator.

The invention resides in that ribs are fashioned in the manner of vanes of a fan wheel and are uniformly distributed along the periphery of a hollow element, which latter element is constructed a a cylindrical tube, wherein the outer edges of the ribs are located on an imaginary cylinder, the diameter of which is smaller than the inner diameter of the container. This construction permits a simple manufacture of the agitator, for example as an injection-molded or die-cast part of plastic or of metal. Due to the ribs operating in the manner of propellers, the construction ensures excellent intermixing, even with minor shaking. In this connection, it is very advantageous to arrange the outer edges of the ribs on an imaginary cylinder, the diameter of which is slightly smaller than the inner diameter of the container, because thereby also the marginal zones of the liquid provided in the container can already be affected with a single upward and downward motion of the agitator and are not initially intermixed by repeated tumbling motions of an agitator.

It is also advantageous that the area coming into contact with the bottom of the paint-filled container, corresponding essentially only to the end faces of the ribs, can be kept at a very small size. Therefore, sticking of the agitator need not be feared even when the unit is unused for a relatively long period of time.

These non-stick properties can be still further improved by selecting the axial length of the enveloping cylinder for the outer edges of the vanes to be larger than the length of the tube, and by extending the leading edges of the vanes at an angle to the longitudinal axis inwardly. By this construction, there result only spot-like contact points in the outermost region of the vanes, so that the contact areas with the bottom of the container of the touch-up stick are reduced to a minimum. The novel design therefore secures in any event the free movability of the agitator within the paint container.

It is also advantageous if, in such an arrangement, for reasons of manufacturing technology, the fan blades proper are fashioned as straight blade vanes oriented merely at an angle with respect to the axial extension of the agitator. Such an agitator can be produced in a very simple way, for example by the die-casting method, from a metal.

It has proved to be sufficient and advantageous, according to a preferred embodiment, to provide four blade-like ribs, the two leading sides of which are oriented at right angles to the tube wall and are offset with respect to each other in the peripheral direction. In this embodiment, flow channels can form between the blade-like ribs; if the length of the agitator is approximately designed so that it corresponds to one-half the length available in the container for the axial movement of the agitator, these flow channels then effect, with a one-time shaking step, already a sufficient turning of the agitator, translated into the desired mixing motion of the liquid. This novel construction of the agitator thus permits a secure, perfect guidance of the agitator in the container, a simple manufacture, and an excellent mixing effect, without the brush provided in the container being subjected to damage by or contact with the moving agitator.

These and other objects, features and advantages of the present invention will become more apparent from the following description when taken in connection with the accompanying drawings, which show, for purposes of illustration only, plural embodiments in accordance with the present invention.

DETAILED DESCRIPTION OF THE PREFERRED EMBODIMENT

Figure 1:
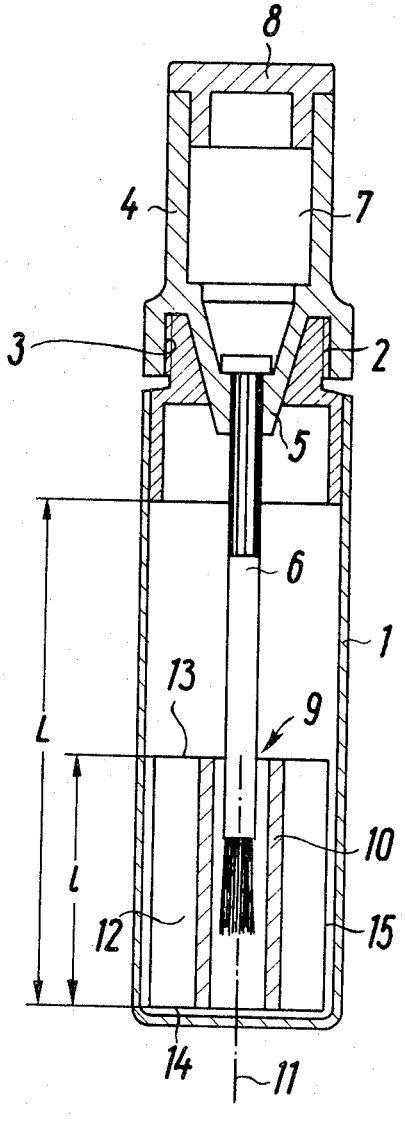
FIG. 1 is a longitudinal section through a touch-up stick for repairing paint damage on automobiles, an agitator according to this invention being inserted around the stick.

FIG. 1 shows a cylindrical container 1 of a touch-up stick to repair paint damage on automobiles, wherein a sealing plug 2 is inserted fixedly joined to the top rim of the container 1. The sealing stopper 2 carries an external thread 3 on which a screw cap 4 is provided constructed in a conventional manner. This screw cap 4 has a conical extension 5, wherein a brush 6 is fixedly clamped. The screw cap furthermore has an inner hollow space 7, which is likewise conventional, this spacing being covered at the top by an additional cap 8. This hollow space can contain, for example, filling material or some other material required to execute the paint repair work.

An agitator 9 is inserted in the container 1, this agitator serving for stirring up the varnish paint present in the container 1 before the repair work is started. This is done by shaking the container 1 in the sealed condition to and fro in the axial direction, whereby the agitator 9, due to its inertia, executes an axial movement within the container 1.

Figure 2:
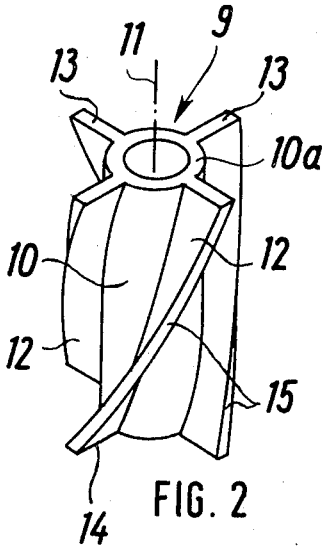
FIG. 2 is a perspective view of the agitator arranged in the touch-up stick of FIG. 1.

The agitator 9 consists, as can be seen particularly also from FIG. 2, of a cylindrical tube 10; ribs 12 extending helically with respect to the longitudinal axis 11 are provided along the periphery of this tube and are fashioned in the manner of the blades of a fan wheel.

In the illustrated embodiment of FIG. 2, four ribs 12 are arranged, the upper end faces 13 of which are arranged, respectively offset by 90° with respect to one another, on the periphery of the tube 10, namely in such a way that they are disposed with the upper end face 10*a* of the tube 10 in a radial plane extending perpendicularly to the longitudinal axis 11. The lower end faces 14, which are likewise in alignment with the lower end face of the tube 10, are respectively offset by about 90° in the peripheral direction with respect to the associated upper end faces of each rib, so that the inlet cross sections of the flow channels formed between the ribs 12 are likewise opposing one another, offset by about 90°.

The total length l of the tube 10 and of the ribs 12 is selected so that it corresponds to approximately one-third or up to one-half of the entire length L available in the container 1 for the axial movement of the agitator 9. By means of this construction, a single shaking step is, in some cases, sufficient to perfectly intermix the paint contained in container 1, due to the twist exerted by the agitator. It is, of course, also possible to orient the ribs 12 at a lesser angle to the longitudinal axis 11, so that the leading sides 13 and 14 of each rib are offset with respect to one another, for example, only by about 45° or 60°. The governing factor is that the ribs are to act on the varnish paint in the manner of fan blades when the agitator 9 executes an axial movement—caused by shaking of the container 1—within the container 1.

The outer edges 15 of the ribs 12 are, in this embodiment, on an imaginary cylinder, the diameter of which is slightly smaller than the inner diameter of the container 1. Thereby the agitator can be perfectly guided within the container 1 without having to fear damage to the brush 6. In this case, it is also advantageous that the entire inner region of the container 1 is under the effect of the twisting action of the agitator 9 during a shaking process, wherein the interior of the tube 10 participates in the mixing procedure by the fact that the lower end of the brush 6 moves in the inner space of tube 10 relatively to the latter. The novel arrangement therefore permits an excellent intermixing of the paint in the container 1 during shaking.

The agitator 9 can be produced in a very simple manner as a single part by use of either the injection-molding method or die-casting method. There are no molding problems. The material used for manufacturing the agitator can be metal, e.g., cast zinc, or also a synthetic resin.

Figure 3:
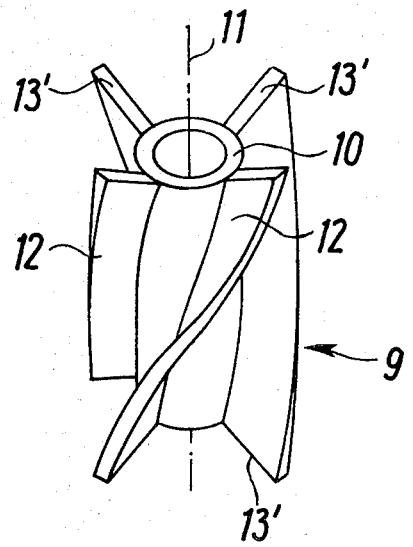
FIG. 3 is a perspective view of a modified agitator wherein the leading edges of the individual fan blades extend obliquely toward the center.

The agitator 9' shown in FIG. 3 consists of an inner, cylindrical tube 10', ribs 12' being provided along the periphery of the tube extending helically with respect to the longitudinal axis 11 of the tube. As in FIGS. 1 and 2, these ribs are constructed in the manner of the blades of a fan wheel and are arranged in this fashion. The leading sides 13 of each of the ribs 12' are not arranged in a common plane flush with the end face of the tube 10' in contrast to the embodiment of FIGS. 1 and 2. Rather, these leading sides are arranged, as can be seen particularly from FIG. 4, at an angle $\alpha$ with respect to the longitudinal axis 11', namely in such a way that these leading sides 13', starting from the imaginary enveloping cylinder having a length L covering the outer edges 15' of the individual blade-like ribs 12', are extended obliquely inwardly back to the length l of the tube 10'. Therefore, in the two illustrated embodiments of FIGS. 3 and 4, there are, on the two outermost boundaries of the agitator 9' at the end face, which boundaries are located at a mutual spacing of L, only four approximately point-like locations 20 on each side which can come into contact with the bottom of the paint container when using the agitator 9' in cylindrical paint containers according to FIG. 1. The contact areas between paint container and agitator 9' are thus reduced to a minimum. The novel agitator thus cannot stick together with pigments of the paint after a relatively long resting period on the bottom of the paint container.

Figure 4:
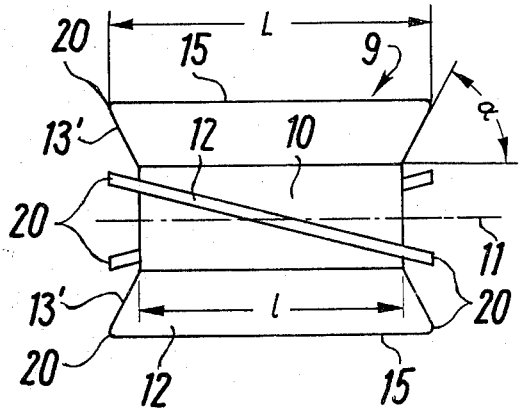
FIG. 4 is a lateral view of an agitator similar to FIG. 1, but wherein the individual blades are not inherently convoluted but rather are fashioned as straight blade vanes oriented at an angle with respect to a longitudinal axis.

As can be seen from FIG. 4, this embodiment differs from FIG. 3 only in that the ribs 12 constructed as fan blades are inclined at an angle to the longitudinal axis 11, but are not inherently twisted. It has been found that the force component effecting a shaking up of the paint is large enough to attain sufficient intermixing even without twist of the ribs. However, if the agitator shown in FIG. 4 is made of one piece, for example of a metal casting, the shape required for this purpose can be manufactured in a substantially simpler manner if the blade twist is eliminated.

While we have shown and described only several embodiments in accordance with the present invention, it is understood that the same is not limited thereto but is susceptible of numerous changes and modifications as would be known to those skilled in the art, given the present disclosure, we therefore to not wish to be limited to the details shown and described herein but intend to cover all such changes and modifications as are encompassed by the scope of the appended claims.

What is claimed is:

1. Cylindrical container for paint or the like, comprising a hollow container body, a cap, a brush attached to the cap, and an agitator constructed as a tubular hollow member guided in the container in the axial direction of the latter, surrounding said brush attached to the cap, and having radially outwardly projecting ribs, characterized in that the ribs are fashioned in the manner of blades of a fan wheel and are uniformly distributed about the periphery of the hollow member, wherein the outer edges of the ribs are located on an imaginary cylinder, the diameter of which is slightly smaller than the inner diameter of the container body, and also characterized in that the ribs are twisted helically with respect to the longitudinal axis of the hollow member.

2. Cylindrical container for paint or the like, comprising a hollow container body, a cap, a brush attached to the cap, and an agitator constructed as a tubular hollow member guided in the container in the axial direction of the latter, surrounding said brush attached to the cap, and having radially outwardly projecting ribs, characterized in that the ribs are fashioned in the manner of blades of a fan wheel and are uniformly distributed about the periphery of the hollow member, wherein the outer edges of the ribs are located on an imaginary cylinder, the diameter of which is slightly smaller than the inner diameter of the container body, and also characterized in that four ribs are provided, each rib having two leading sides one on each end thereof, said two leading sides being mutually offset in the peripheral direction, but extending perpendicularly to a tangent placed on the outer diameter of the tube.

3. Agitator according to claim 1, characterized in that the ribs have leading sides, each leading side being in alignment with an end face of the tube.

4. Agitator according to one of claims 1 or 2 or 3, characterized in that the length of the ribs corresponds to approximately one-third to one-half of the length available in the hollow container for the axial movement of the agitator.

5. Agitator according to one of claims 1–2, characterized in that the tube is formed unitarily with the ribs.

6. Agitator according to one of claims 2, characterized in that the leading sides respectively, each are in alignment with the end face of the tube.

7. Cylinder container for paint or the like, comprising a hollow container body, a cap, a brush attached to the cap, and an agitator constructed as a tubular hollow member guided in the container in the axial direction of the latter, surrounding said brush attached to the cap, and having radially outwardly projecting ribs, characterized in that the ribs are fashioned in the manner of blades of a fan wheel and are uniformly distributed about the periphery of the hollow member, wherein the outer edges of the ribs are located on an imaginary cylinder, the diameter of which is slightly smaller than the inner diameter of the container body, and also characterized in that the ribs have leading edges at opposite ends thereof, and wherein the axial length of the outer edges located on the imaginary cylinder is longer than the length of the tube, and the leading edges of the ribs extend inwardly at an angle with respect to the longitudinal axis from the outer edges to the hollow tube.

8. Agitator according to claim 7, characterized in that the ribs are fashioned as straight blade vanes, but are arranged on the hollow tube inclined at an angle to the longitudinal axis of the agitator.

* * * * *